US008171646B2

(12) United States Patent
Chiu

(10) Patent No.: US 8,171,646 B2
(45) Date of Patent: May 8, 2012

(54) SCRAPER

(75) Inventor: Lian-Zhen Chiu, Taichung Hsien (TW)

(73) Assignee: Goodly-CH Enterprise Co., Ltd., Ta-Tu Hsiang, Taichung Hsien (TW)

( * ) Notice: Subject to any disclaimer, the term of this patent is extended or adjusted under 35 U.S.C. 154(b) by 379 days.

(21) Appl. No.: 12/613,621

(22) Filed: Nov. 6, 2009

(65) Prior Publication Data

US 2011/0094109 A1 Apr. 28, 2011

(30) Foreign Application Priority Data

Oct. 27, 2009 (TW) ..... 98136271 A

(51) Int. Cl.
*B26B 1/00* (2006.01)

(52) U.S. Cl. ..... 30/169; 30/335

(58) Field of Classification Search ..... 30/162, 30/163, 169, 335; 15/236.1, 93.1; 29/81.17; D32/46, 48
See application file for complete search history.

(56) References Cited

U.S. PATENT DOCUMENTS

| | | | | | |
|---|---|---|---|---|---|
| 870,877 | A | * | 11/1907 | Fleming | 30/169 |
| 1,500,644 | A | * | 7/1924 | Scalbom | 30/162 |
| 1,567,943 | A | * | 12/1925 | Grush | 30/335 |
| 2,122,263 | A | * | 6/1938 | Pinter | 30/169 |
| 3,078,572 | A | * | 2/1963 | Everton | 30/169 |
| D223,401 | S | * | 4/1972 | Meisner | D32/48 |
| 3,855,700 | A | * | 12/1974 | Gerson et al. | 30/162 |
| 3,965,575 | A | * | 6/1976 | Stunger | 30/335 |
| 4,238,883 | A | * | 12/1980 | Jacobson et al. | 30/162 |
| 4,558,517 | A | * | 12/1985 | Gringer | 30/169 |
| D282,881 | S | * | 3/1986 | Gringer | D32/48 |
| 4,575,936 | A | * | 3/1986 | Gringer | 30/169 |
| 4,612,707 | A | * | 9/1986 | Shea | 30/162 |
| 4,955,138 | A | * | 9/1990 | Henke et al. | 30/169 |
| 4,979,300 | A | * | 12/1990 | Blank et al. | 30/169 |
| 5,056,226 | A | * | 10/1991 | Gringer | 30/169 |
| 5,319,853 | A | * | 6/1994 | Schmidt | 30/169 |
| 5,433,004 | A | * | 7/1995 | Thompson et al. | 30/169 |
| 5,528,832 | A | | 6/1996 | Schmidt | 30/169 |
| D463,639 | S | * | 9/2002 | Panfili et al. | D32/48 |
| D467,395 | S | * | 12/2002 | McCool | D32/48 |
| 6,519,801 | B1 | * | 2/2003 | Chao | 30/169 |
| 6,715,210 | B2 | * | 4/2004 | Chao | 30/169 |
| D489,851 | S | * | 5/2004 | Jones et al. | D32/48 |
| 6,775,912 | B2 | * | 8/2004 | Panfili et al. | 30/169 |
| 6,898,855 | B2 | * | 5/2005 | Jones et al. | 30/169 |
| D562,667 | S | * | 2/2008 | Wu et al. | D32/48 |

(Continued)

FOREIGN PATENT DOCUMENTS

TW 201114529 A * 5/2011

*Primary Examiner* — Jason Daniel Prone
(74) *Attorney, Agent, or Firm* — Alan Kamrath; Kamrath IP Lawfirm, PA

(57) ABSTRACT

A scraper includes a shell, a first controlling mechanism moveably installed within the shell for carrying a razor. The first controlling mechanism is moveable between a first position that the razor is exposed outside the shell and a second position that the razor is concealed in the shell. The scraper also includes a second controlling mechanism being independent of the first controlling mechanism and being utilized to selectively lock the razor therein. The razor is adapted to be removed from the first controlling mechanism when the second controlling mechanism is in an unlocked position. In addition, the scraper includes a compartment defined in the shell for storing unused razor(s).

20 Claims, 15 Drawing Sheets

U.S. PATENT DOCUMENTS

| | | | | |
|---|---|---|---|---|
| D586,512 | S * | 2/2009 | van Deursen | D32/46 |
| D624,262 | S * | 9/2010 | Gringer | D32/46 |
| 7,814,608 | B1 * | 10/2010 | Catello | 30/169 |
| D627,942 | S * | 11/2010 | Chiu | D32/48 |
| 7,930,830 | B2 * | 4/2011 | Gringer et al. | 30/169 |
| 7,930,831 | B2 * | 4/2011 | Lin | 30/169 |
| 2004/0143924 | A1 * | 7/2004 | Salmon | 15/236.1 |
| 2005/0081318 | A1 * | 4/2005 | Boutilier | 30/169 |
| 2005/0120564 | A1 * | 6/2005 | Chen Lin | 30/169 |
| 2009/0199411 | A1 * | 8/2009 | van Deursen et al. | 30/169 |
| 2009/0235535 | A1 * | 9/2009 | Circosta et al. | 30/162 |
| 2009/0265940 | A1 * | 10/2009 | Wahl | 30/169 |
| 2010/0077620 | A1 * | 4/2010 | Lin | 30/169 |
| 2010/0325898 | A1 * | 12/2010 | Corron et al. | 30/162 |
| 2011/0035948 | A1 * | 2/2011 | Wang | 30/169 |
| 2011/0146083 | A1 * | 6/2011 | Lin | 30/169 |

* cited by examiner

SCRAPER

BACKGROUND OF THE INVENTION

1. Field of the Invention

The present invention relates to a scraper and, in particular, to a scraper that has a releasably mounted razor and that the razor can move between an operation position and a stowed position. Further, the scraper is adapted for storing the unused razor(s).

2. Description of the Related Art

Conventional scrapers have their razors fixed in an exposed position. But it is hazardous, so for safety's sake some scrapers would include covers that are adapted to conceal the razors when the scrapers are not in use, and some scrapers would enable their razors to be operable between an exposed position when in use and a concealed position when not in use.

U.S. Pat. No. 5,528,832 shows a scraper with a razor and a cover being moveable to expose and conceal the razor. In addition, the cover can be moved to a position such that it can be disassembled from the scraper in order to change the razor. In spite of that, it is troublesome that user has to remove the cover for replacement of the razor.

The present invention is, therefore, intended to obviate or at least alleviate the problems encountered in the prior art.

SUMMARY OF THE INVENTION

According to the present invention, a scraper includes a shell, a razor, a first controlling mechanism including a first holding device and a second holding device cooperating together for carrying the razor. The first controlling mechanism is moveably installed within the shell and is moveable between a first position that the razor is exposed outside the shell and a second position that the razor is concealed in the shell. The scraper also includes a second controlling mechanism being independent of the first controlling mechanism. The second controlling mechanism includes a pressing member disposed between the first and second holding devices. The pressing member is pivotally mounted on the second holding device and is operable to move between a locked position that the razor is locked in the first controlling mechanism and an unlocked position that the razor is adapted to be disengaged and removed from the first controlling mechanism.

It is therefore an object of the present invention that the first and second controlling mechanism are independent from each other to prevent user from accidentally unlock the razor when in use.

It is another object of the present invention that the scraper includes a compartment for storing unused razor(s).

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

BRIEF DESCRIPTION OF THE DRAWINGS

For the present disclosure to be easily understood and readily practiced, the present disclosure will now be described in conjunction with the following figures, wherein.

DETAILED DESCRIPTION OF THE PREFERRED EMBODIMENT

Figure 1:
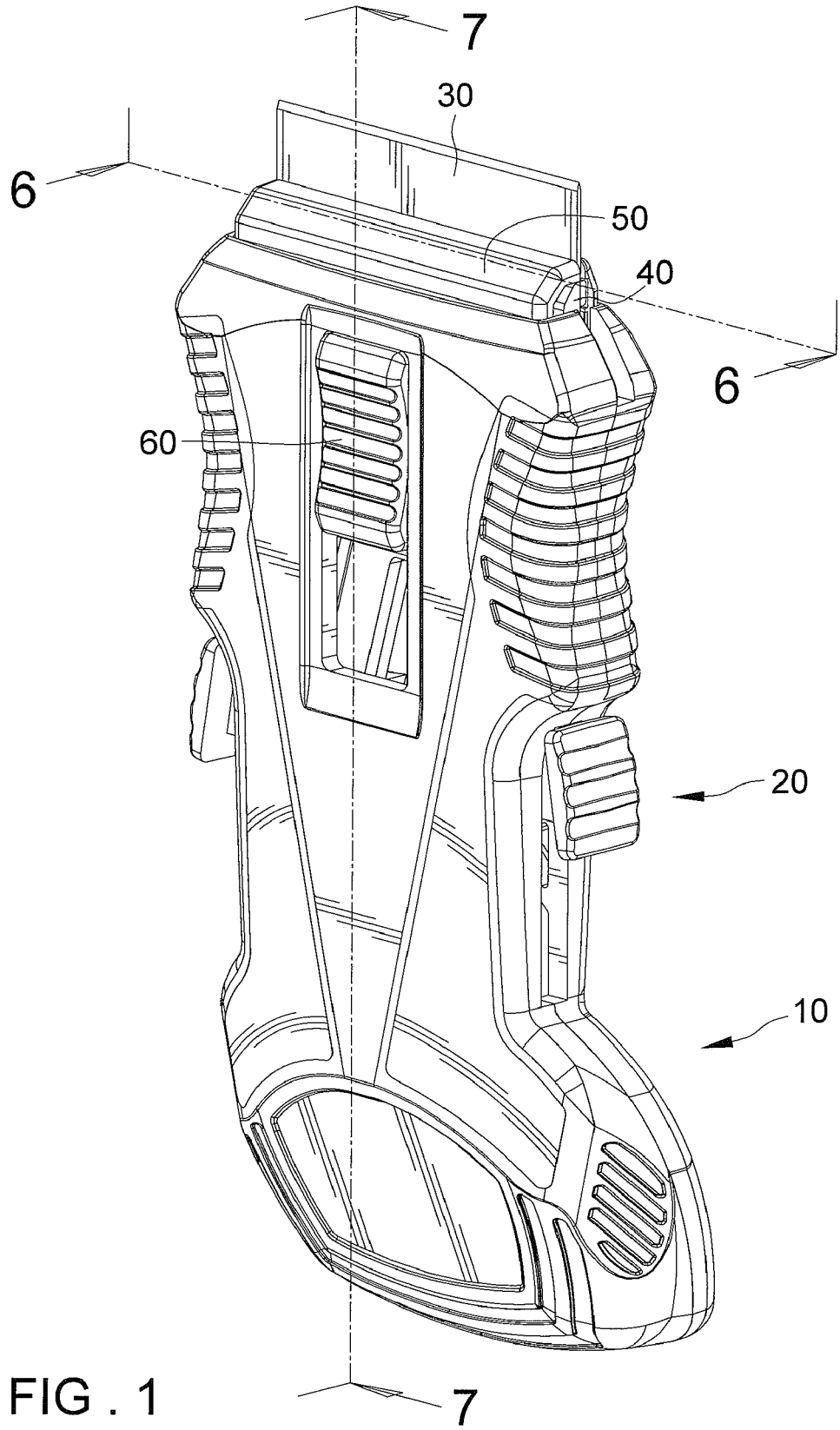
FIG. 1 is a perspective view of a scraper in accordance with the present invention.
Figure 2:
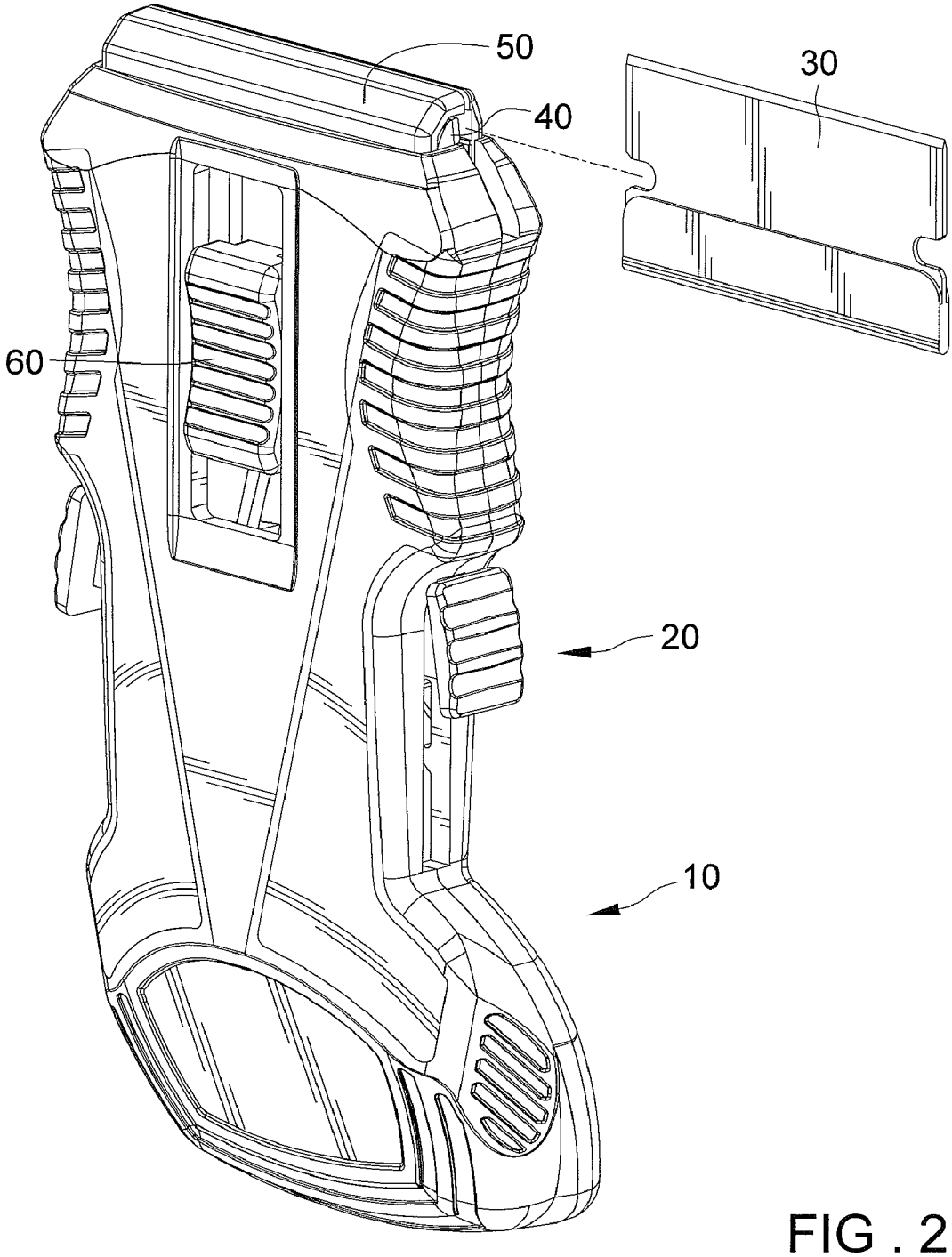
FIG. 2 is an illustrative view showing the removal of a razor of the scraper.
Figure 3:
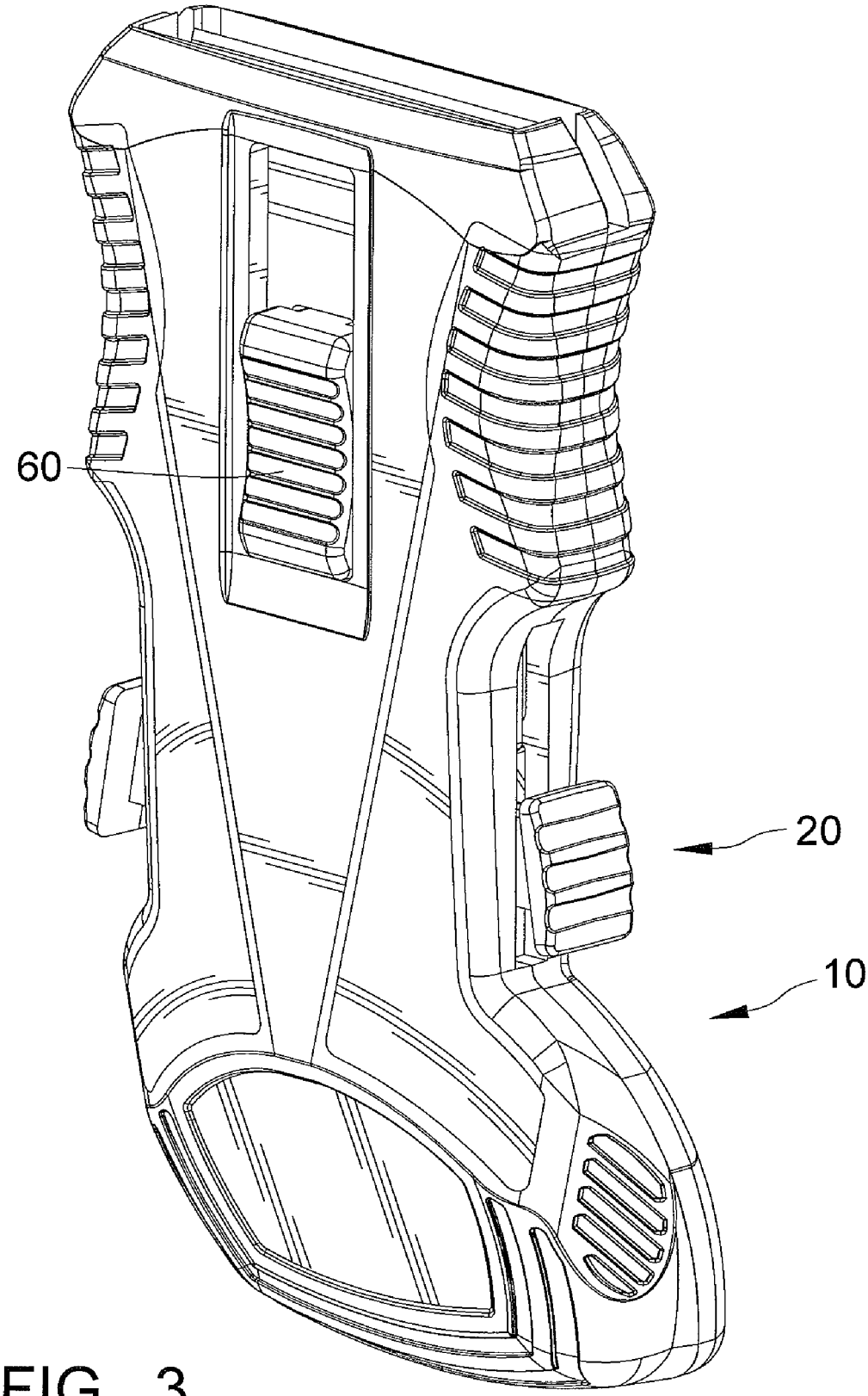
FIG. 3 is a perspective view showing the razor in a concealed position.
Figure 4:
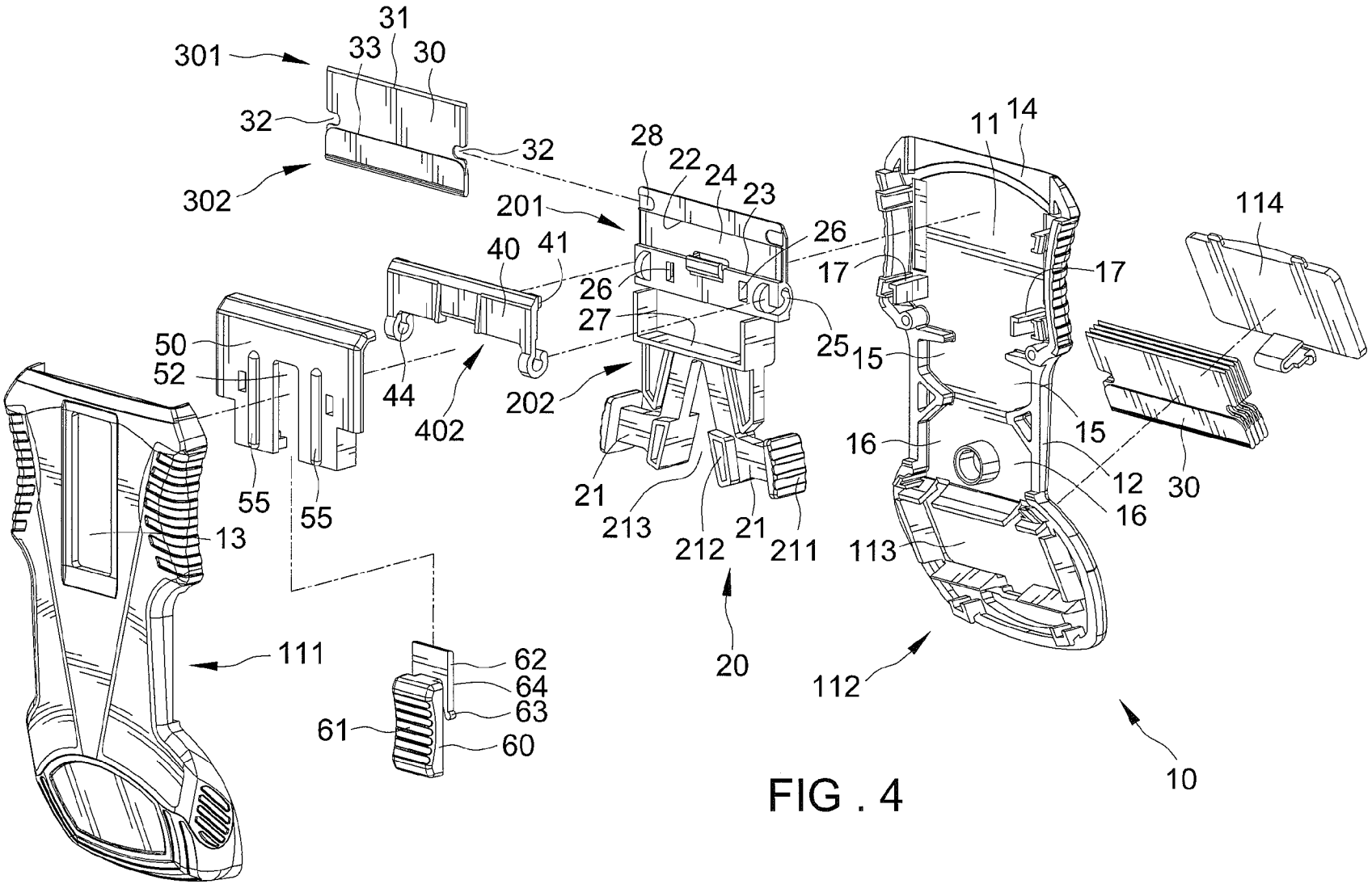
FIG. 4 is an exploded perspective view of the scraper embodying the present invention.
Figure 5:
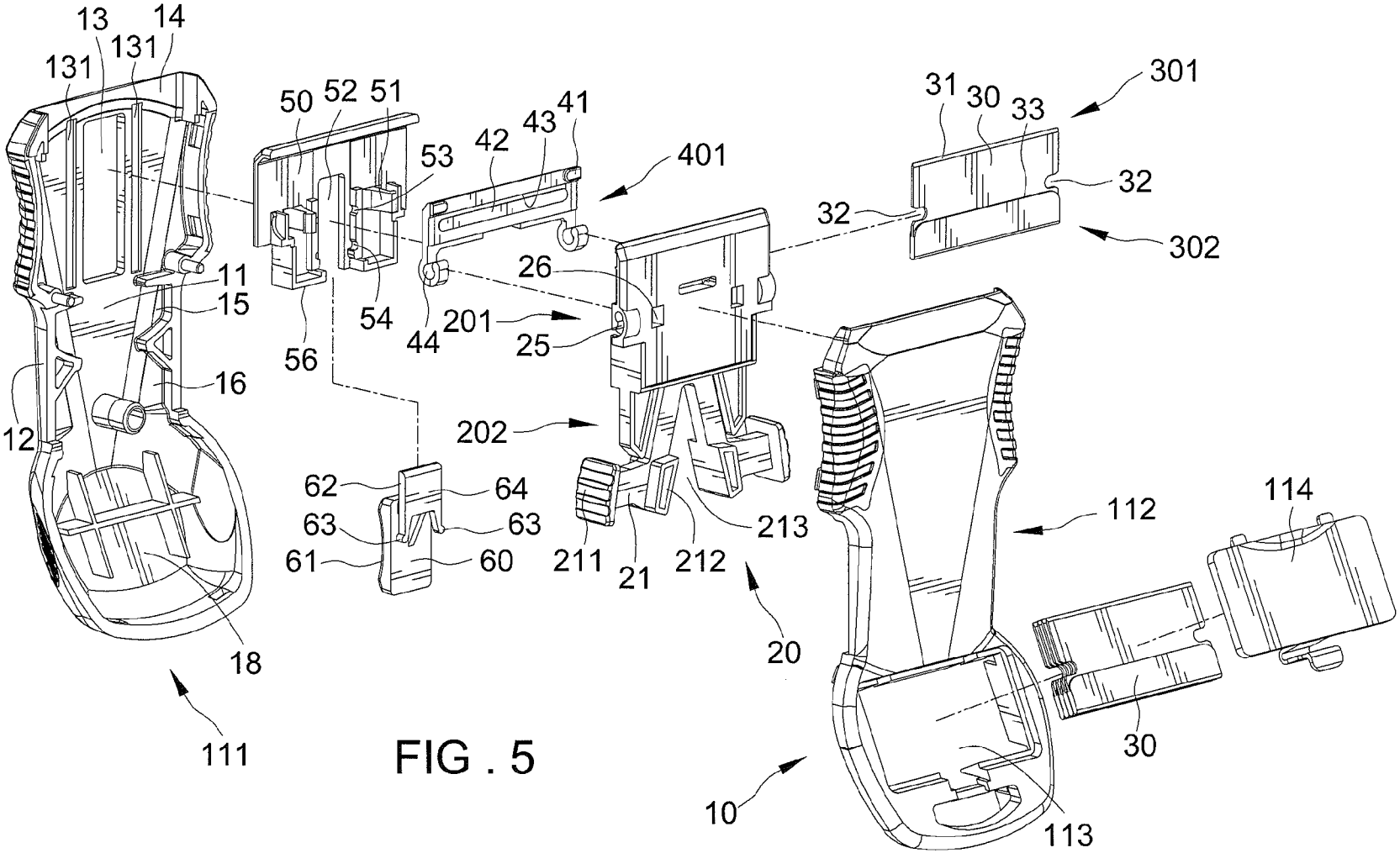
FIG. 5 another exploded perspective view of the scraper but taken from a different view than that of FIG. 4.
Figure 6:
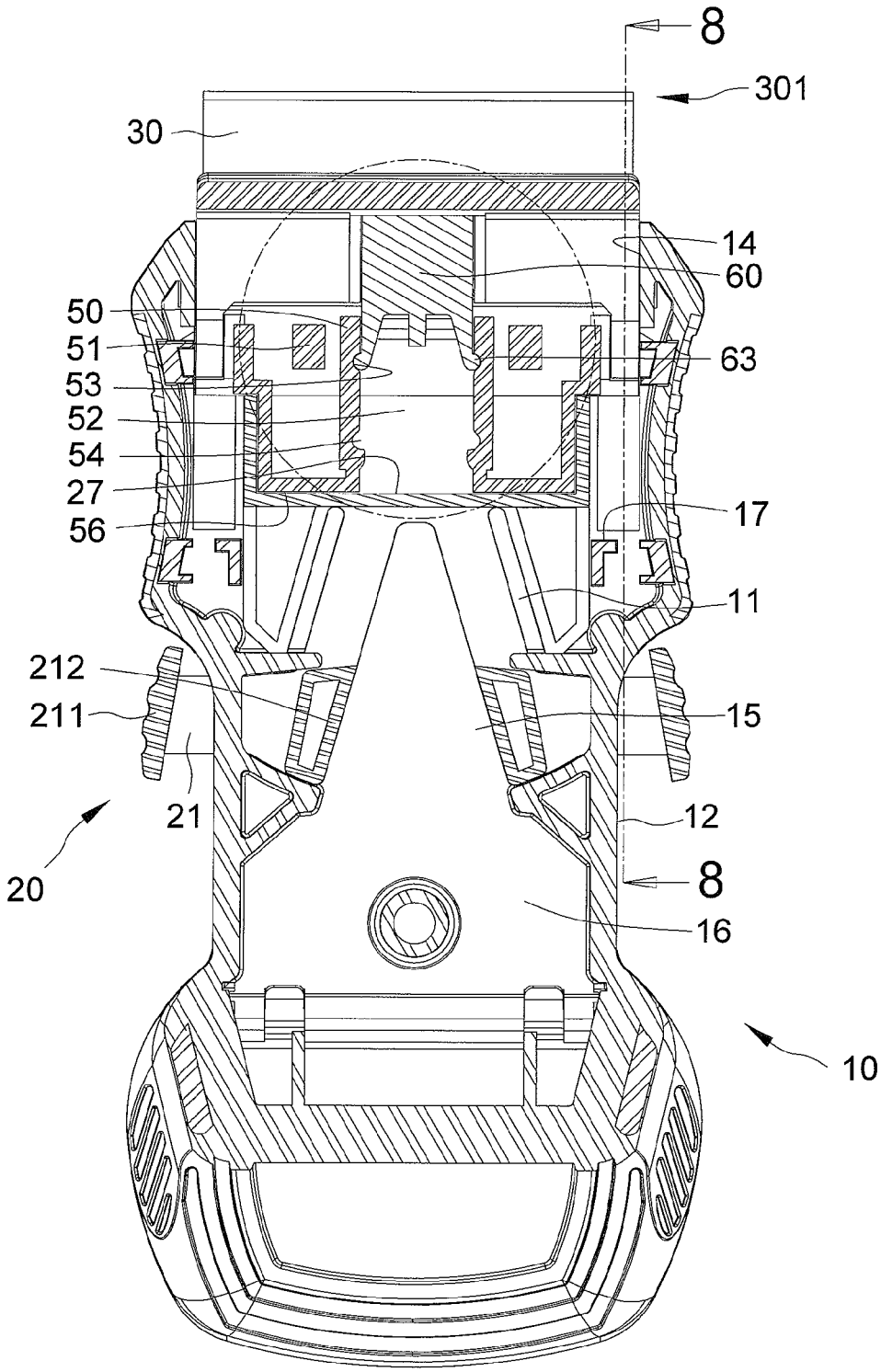
FIG. 6 is a cross-sectional view taken along line 6-6 of FIG. 1.
Figure 7:
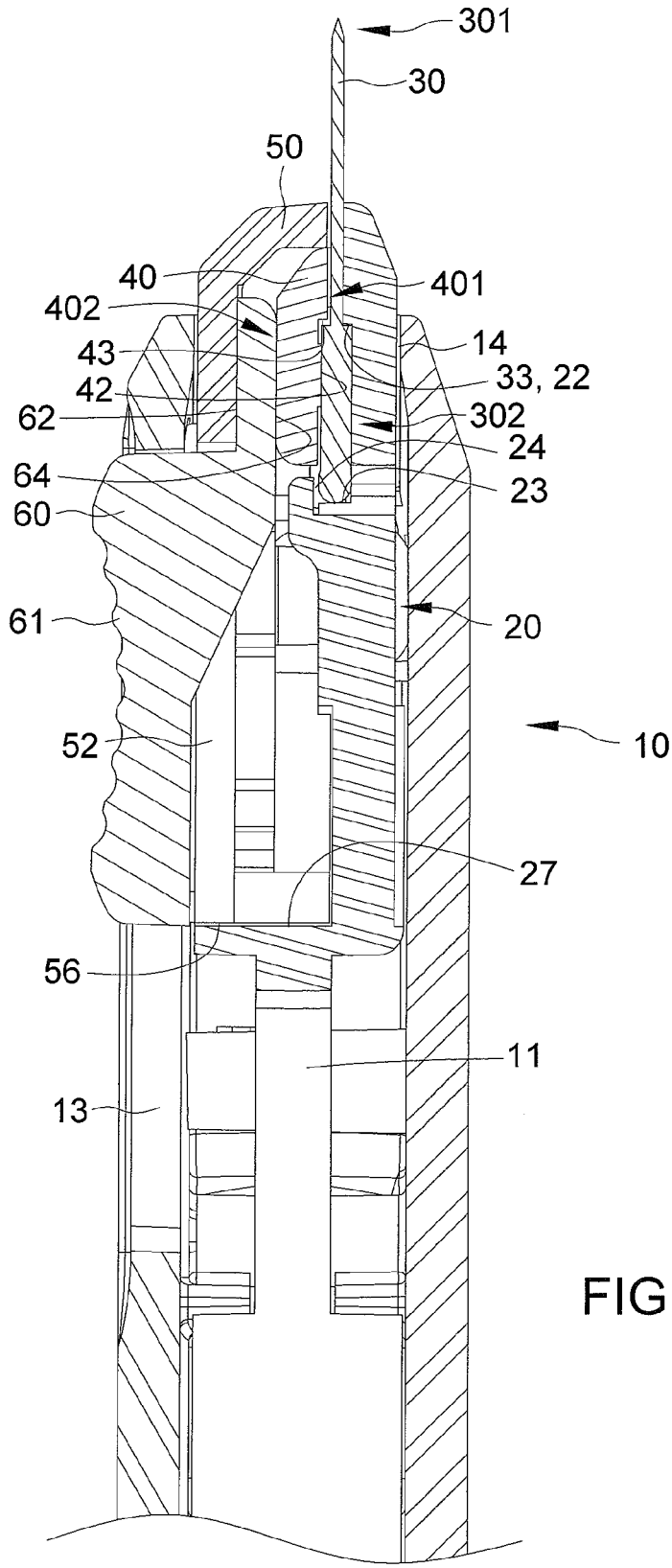
FIG. 7 is a cross-sectional view taken along line 7-7 of FIG. 1.
Figure 8:
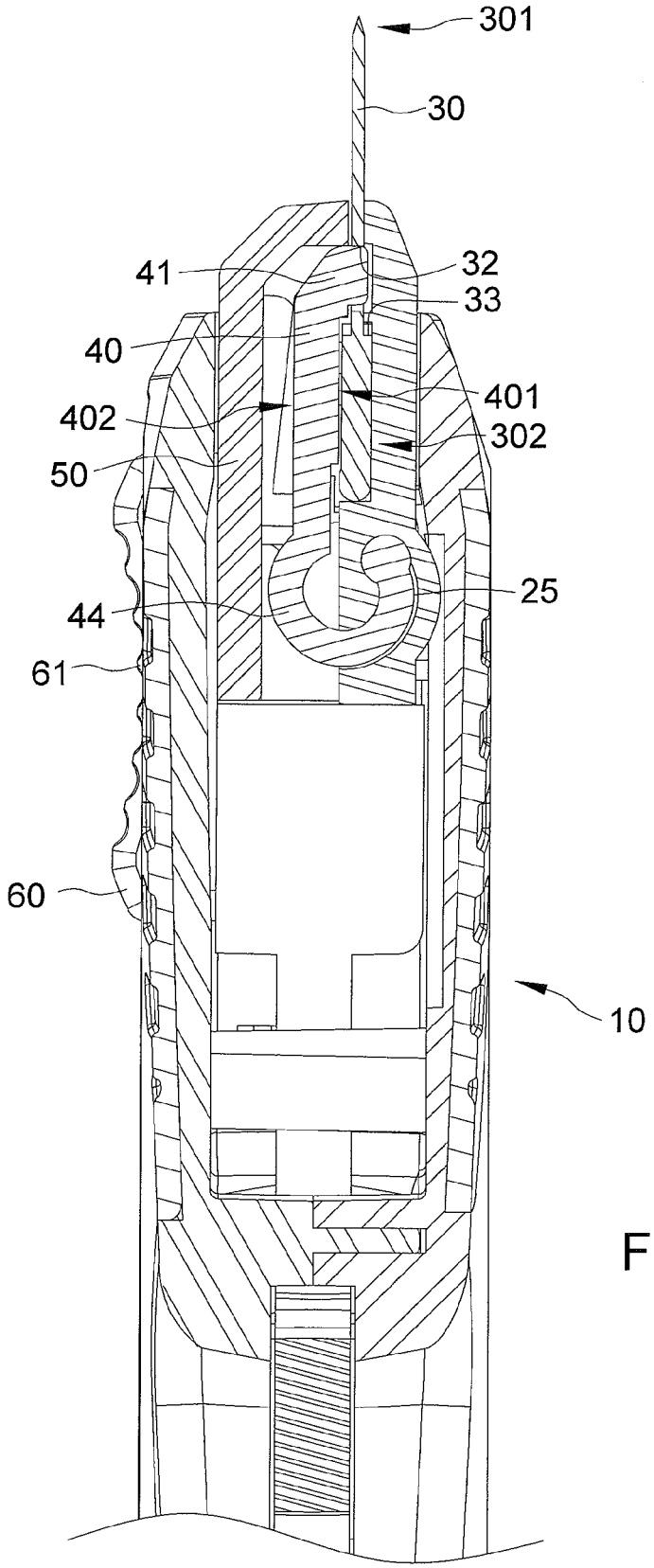
FIG. 8 is a cross-sectional view taken along line 8-8 of FIG. 6.
Figure 9:
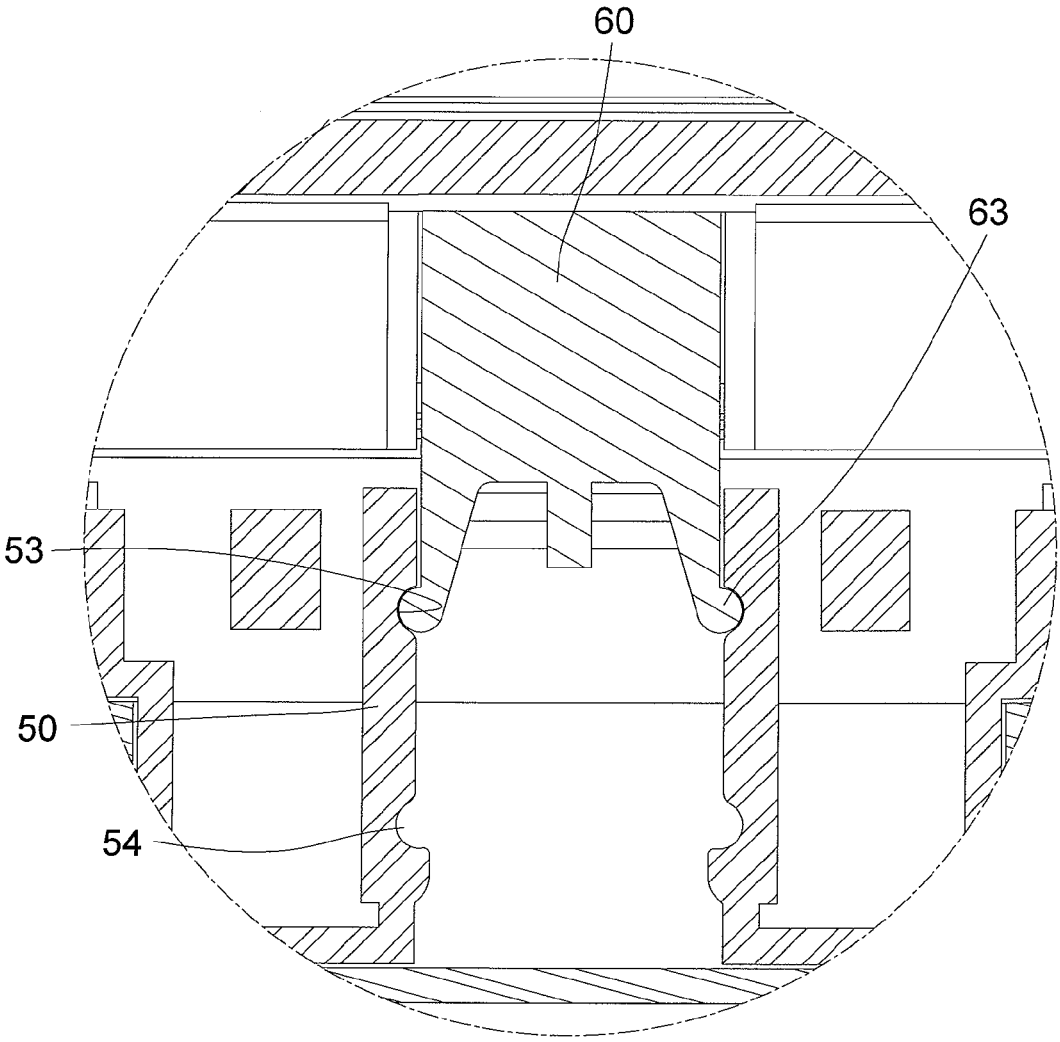
FIG. 9 is a partial, enlarged view of FIG. 6.
Figure 10:
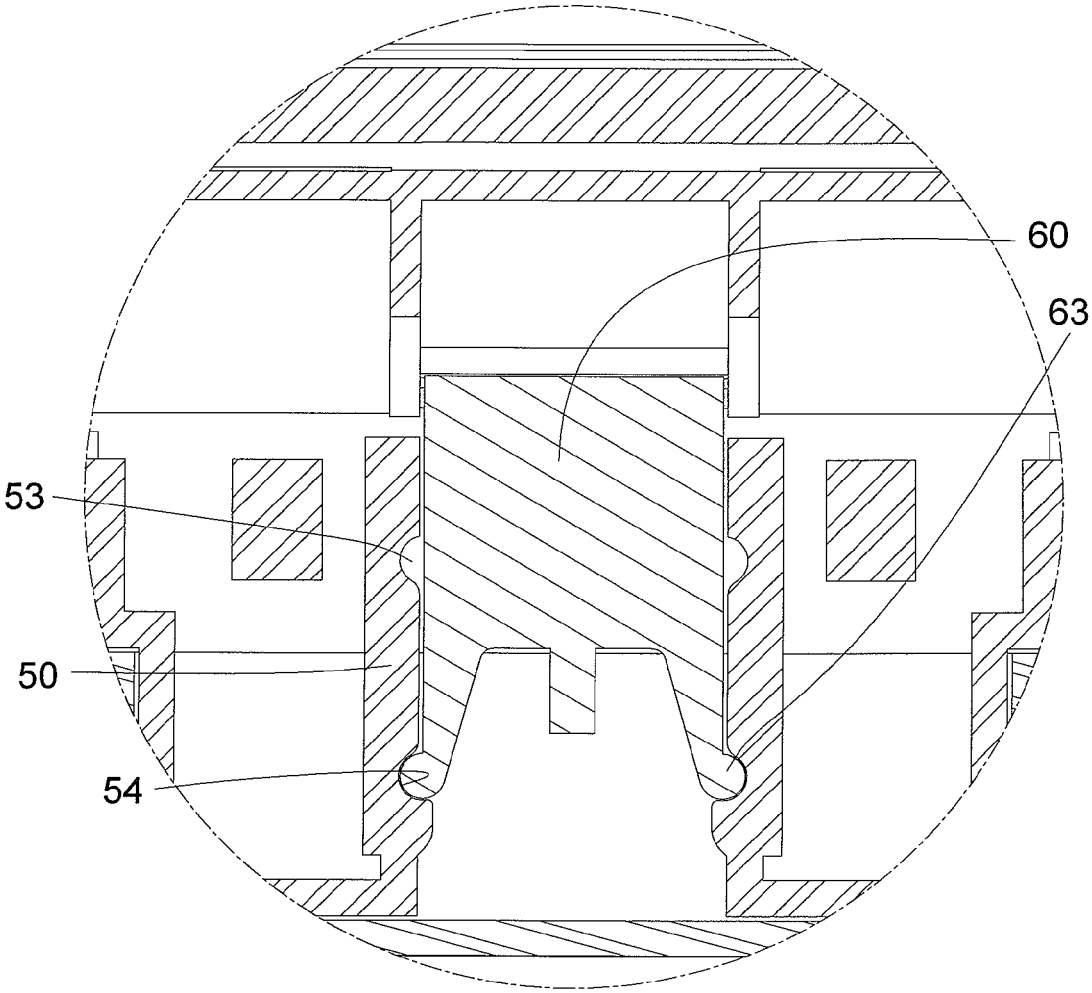
FIG. 10 is a cross sectional view similar to FIG. 9 but shows a controlling mechanism in another position to unlock the razor from the scraper.
Figure 11:
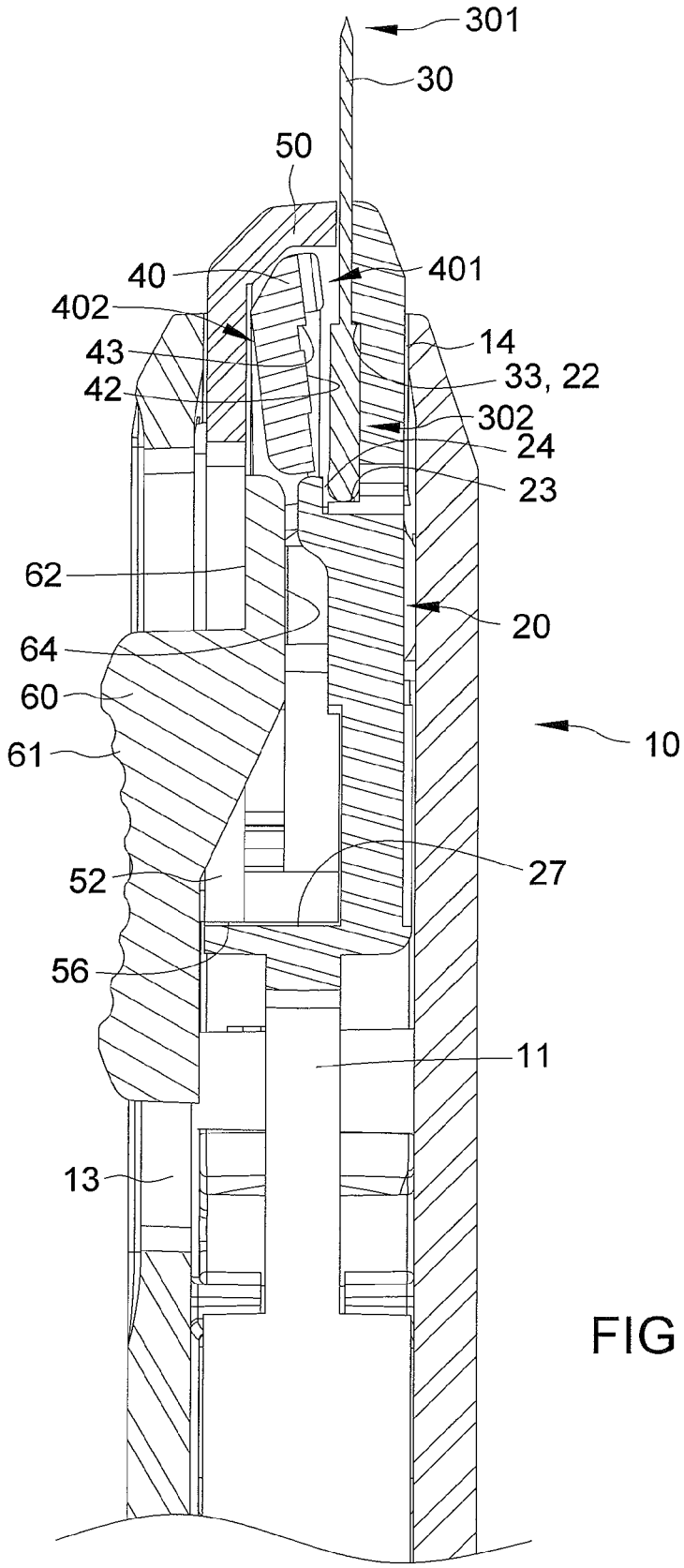
FIG. 11 is a cross sectional view similar to FIG. 7 but shows the controlling mechanism in the position of FIG. 10.
Figure 12:
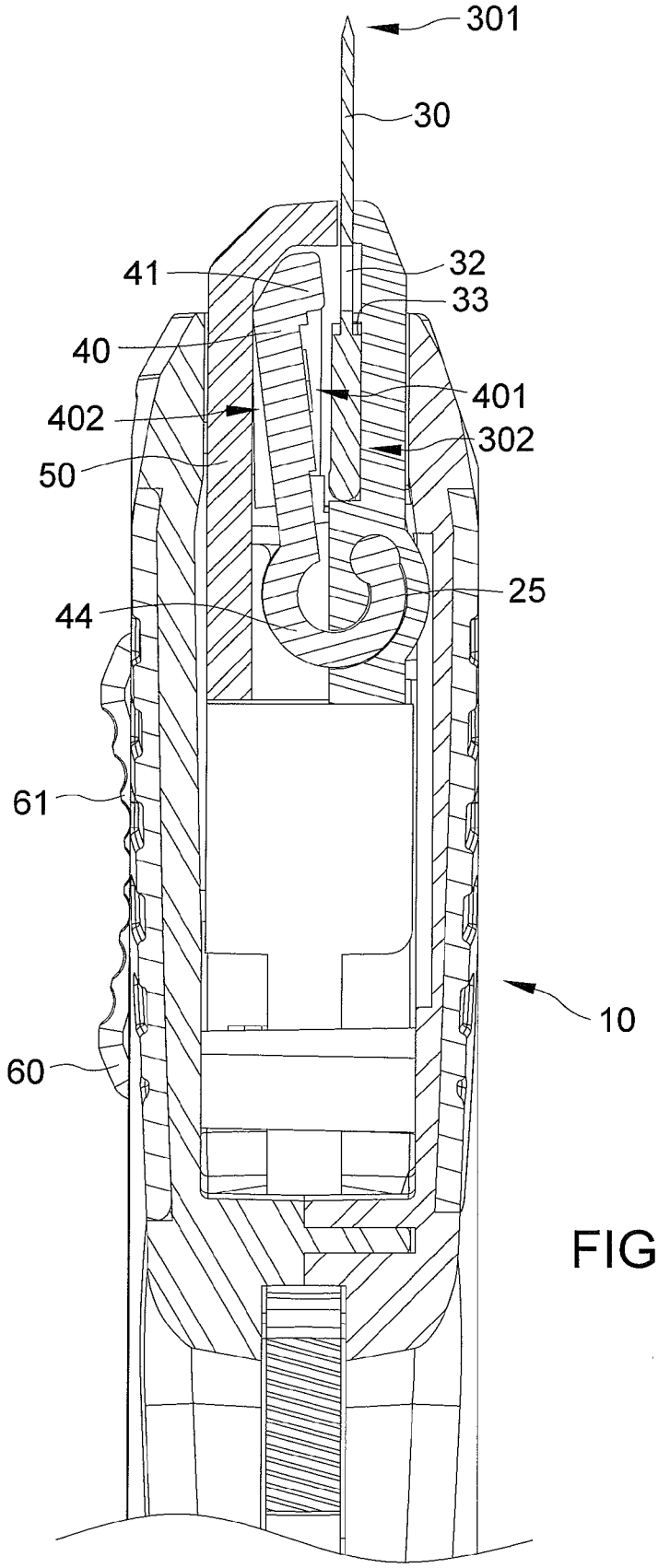
FIG. 12 is a cross sectional view similar to FIG. 8 but shows the controlling mechanism in the position of FIG. 10.
Figure 13:
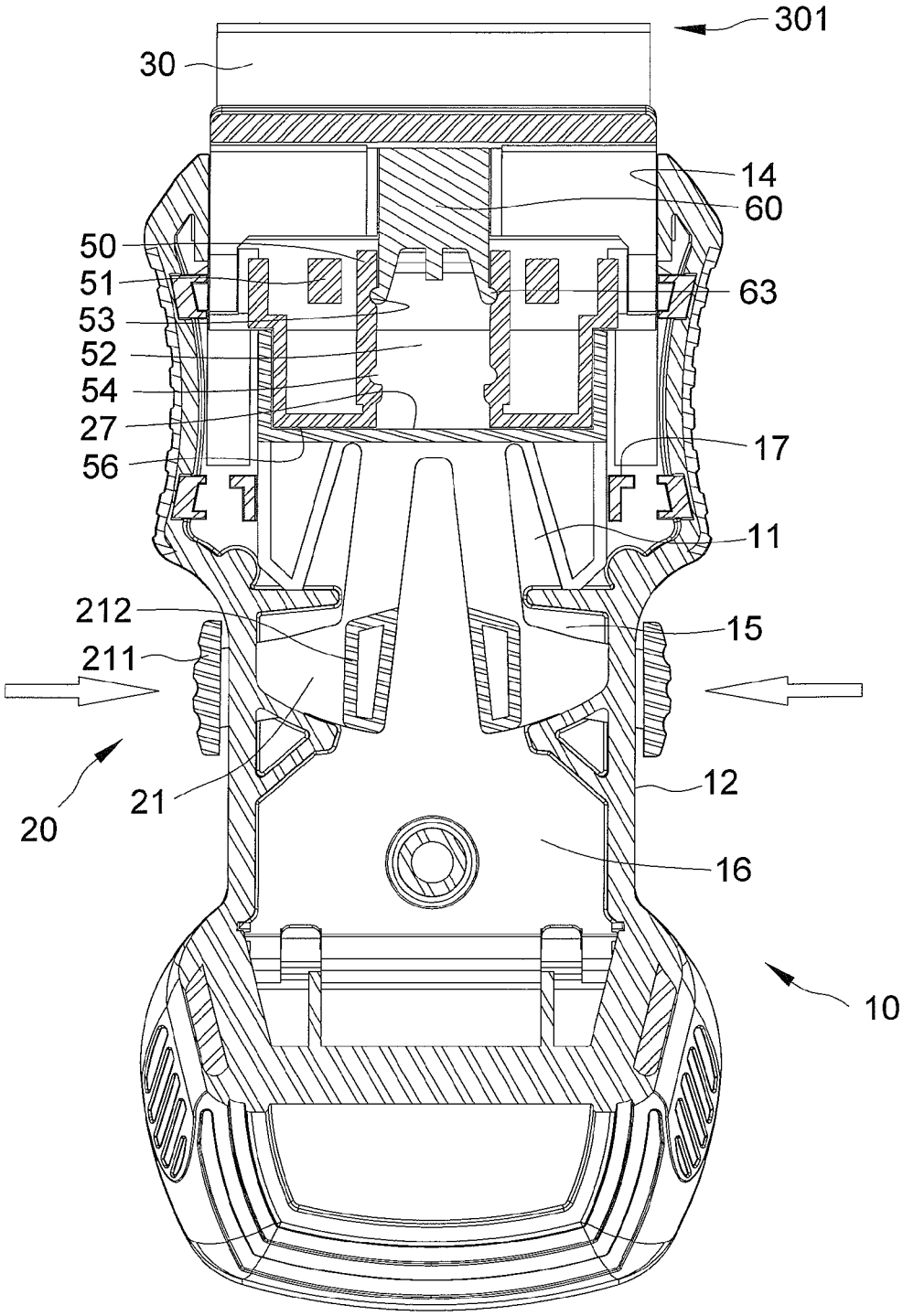
FIG. 13 is an extended cross sectional view of FIG. 6 and shows the operation of another controlling mechanism.
Figure 14:
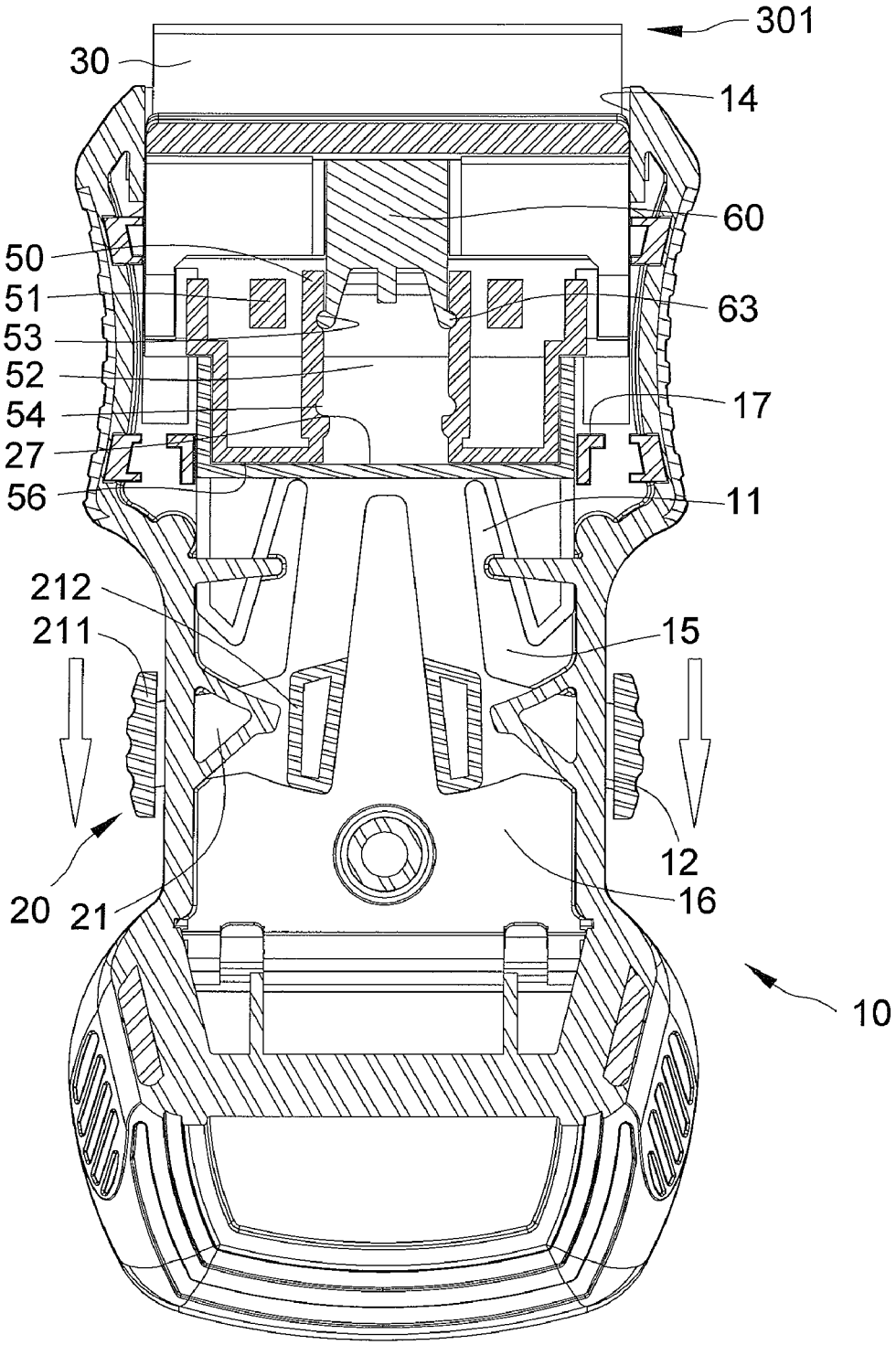
FIG. 14 is an extended cross sectional view of FIG. 13 and shows the controlling mechanism urged in order to move the razor to the concealed position.
Figure 15:
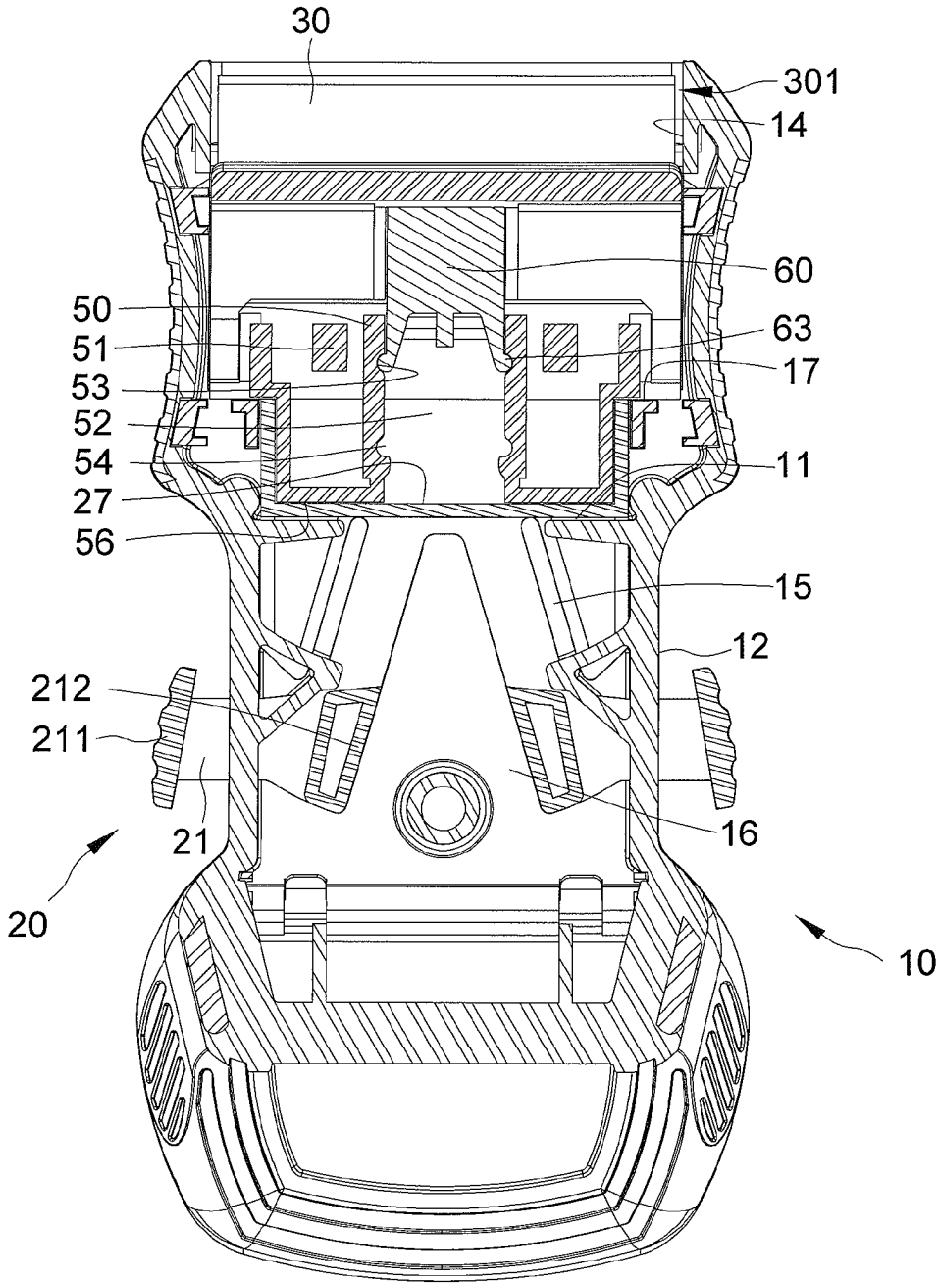
FIG. 15 is an extended cross sectional view of FIG. 14 and show the razor in the concealed position as shown in FIG. 3.

Referring to the drawings, a scraper in accordance with the present invention is adapted for paint-removing application.

The scraper includes a shell 10, a first controlling mechanism moveably installed within the shell 10 for carrying a razor 30. The first controlling mechanism is moveable between a first position that the razor 30 is exposed outside the shell 10 and a second position that the razor 30 is concealed in the shell 10. The scraper also includes a second controlling mechanism being independent of the first controlling mechanism and being utilized to selectively lock the razor 30 therein. Thus, when the scraper is in use, the razor 30 is prevented from disengagement from the scraper. In addition, the razor 30 is adapted to be removed from the first controlling mechanism when the second controlling mechanism is in an unlocked position.

The shell 10 is made up by a first shell member 111 and a second shell member 112, and the interior sides of the first 111 and second 112 shell members cooperate to form an accommodating space 11 for receiving the first controlling mechanism. In addition, each of the first 111 and second 112 shell members includes a peripheral wall encompassing its interior side, and the peripheral walls are adapted to be joined together to form a lateral edge of the shell 10. The lateral edge includes a first opening defining an open end 14 of the shell 10 that would allow the first controlling mechanism to extend outside the shell 10, and two second opposing openings defining two slots 12. Two operation handles 211 of the first controlling mechanism, which expose outside the shell 10, are moveable in the slots 12, respectively, upon movement of the first controlling mechanism between the first and second positions. The shell 10 further includes a first locking section 15 and a second locking section 16 defined by the accommodating space 11, and when the first controlling mechanism is in the first position the first controlling mechanism is locked in the first locking section 15, whereas when the first controlling mechanism is in the second position the first controlling mechanism is locked in the second locking section 16. Preferably, the first locking section 15 is more adjacent to the open end 14 than the second locking section 16. In this connection, the first controlling mechanism would move away from the open end 14 to enable the shell 10 to conceal the razor 30 as it moves from the first locking section 15 to the second locking section 16.

Further, the first shell member 111 includes a compartment 18 defined by its interior side for storing unused razors 30 and the razor 30 removed from the first controlling mechanism. The second shell member 112 includes a cavity 113 extending therethrough, i.e. from the interior side to the exterior side, for allowing the unused razors 30 to put in the shell 10. The razors 30 are encapsulated in the shell 10 by a cover 114. The cover 114 is removably mounted on the shell 10.

In addition, the first shell member 111 includes a hole 13 extending therethrough, i.e. from the interior side to the exterior side, and two guiding grooves 131 recessed from the interior side. Preferably, one guiding groove 131 disposed on the right side of the slot 13 while the other disposed on the left side, respectively. The second shell member 112 includes two stopping ribs 17 extending from its interior side and being adapted to stop the first controlling mechanism from moving further away from the predetermined distance with respect to the open end 14.

The razor 30 includes two opposing edges and with one edge defining a scraping edge 301 including a scraping section 31 extending thereon while the other edge defining a mounting edge 302. The razor 30 also includes two opposing notches 32 and with one notch formed on one of two lateral edges that extends between the scraping edge 301 and the mounting edge 302. In addition, the mounting edge 302 of the razor 30 includes two ledges 33 extending between the lateral edges thereof and with one ledge 33 extending on its interior side while the other ledge 33 extending on its exterior side.

The first controlling mechanism includes a first holding device 20 and a second holding device 50 for carrying the razor 30. Specifically, the razor 30 is disposed between the interior sides of the first 20 and second 50 holding devices. Additionally, the first holding device 20 includes a proximal end 201 including a channel 24 defined in the interior side thereof for receiving the mounting edge 302 of the razor 30. The first holding device 20 may also include two cavities 28 recessed in the interior side thereof and corresponding to two notches 32, respectively, when the razor 30 is carried on the first controlling mechanism. The channel 24 has a shape conforming to the mounting edge 302 and includes a proximal end disposed at one lateral edge of the first holding device 20 and a distal end disposed at the other lateral edge. Additionally, the channel 24 includes a first flange 22 and a second flange 23 extending in a height with respect to the bottom edge of the channel 24 and embanks the channel 24. So, when the mounting edge 302 of the razor 30 is disposed in the channel 24, the first flange 22 is adapted to be abutted by the ledge 33 on the interior side of the razor 30, thereby keeping the razor 30 in the channel 24. Moreover, the channel 24 does not have flanges extending from the bottom edge at either the proximal or distal ends thereof. In this connection, user can operably move the razor 30 out of the channel 24 from one of the proximal and distal ends.

The first holding device 20 further includes a distal end 202 including two legs 21 disposed in the shell 10 and adapted to be operated for moving the first controlling mechanism between the first and second positions. Each leg 21 includes two terminal ends and with one terminal end formed on the distal end 202 of the first holding device 20 and the other terminal end exposing outside the shell 10. So, the two operation handles 211 set forth hereinbefore are formed on the terminal ends of the two legs 21 that expose outside the shell 10, respectively. In the embodiment, the legs 21 are substantially L shaped. In addition, each leg 21 includes a retaining section 212 being selectively engagable in the first 15 and second 16 locking sections to hold the first holding device 20 between the first and second positions. Moreover, the legs 21 are depressible towards each other to enable their associated retaining sections 212 to disengage from one of the first and second 16 locking sections and thereafter engage with the other of the first and second 16 locking sections, and include a gap 213 defined therebetween for providing resiliency. In this connection, user can depress the operation handles 211 to make the legs 21 move towards each other and such that the size of the gap 213 is reduced.

In addition, the first holding device 20 includes two connecting grooves 25 defined in the interior side thereof for pivotally receiving a pressing member 40 of the second controlling mechanism such that the pressing member 40 is adapted to be pivoted to selectively abut the razor 30 in the first controlling mechanism to lock the razor 30 therein. The pressing member 40 is disposed between the first 20 and second 50 holding devices of the first controlling mechanism. Additionally, the pressing member 40 includes two protrusions 41 extending from its interior side 401 and adapted to insert through two notches 32 of the razor 30 carried in the first controlling mechanism and abut against the bottom surface of two cavities 28 of the first holding device 20, respectively. Moreover, the interior side 401 defines a pressing face 42 that is adapted to abut against the razor 30. The pressing face 42 includes a flange 43 that is adapted to be abutted by the ledge 33 on the exterior side of the razor 30, thereby facilitating to keep the razor 30 in position. The pressing member 40 also includes two lugs 44 pivotally received in two connecting grooves 25 of the first holding device 20, respectively. So, when the pressing member 40 is pivoted to lock the razor 30 in the first controlling mechanism, the protrusions 41 would be inserted through the notches 32 and abut against the bottom surface of two cavities 28, the pressing face 42 would abut against the exterior side of the razor 30, and the flange 43 would be abutted by the ledge 33. On the contrary, when the pressing member 40 is pivoted to unlock the razor 30 from the first controlling mechanism, the protrusions 41 would disengage from the bottom surface of two cavities 28 and the notches 32, the pressing face 42 would disengage from the exterior side of the razor 30, and the flange 43 would disengage from the ledge 33. In this connection, user can remove the razor 30 from the first controlling mechanism and store it in the compartment 18.

Further, the first holding device 20 includes two orifices 26 extending from the interior side to the exterior side, and a shelf 27 extending from the interior side. The shelf 27 is utilized for receiving and supporting the second holding device 50. Particularly, the second holding device 50 includes a distal end including a foot 56 that is adapted to abut against the inner peripheral edge of the shelf 27. Additionally, the second holding device 50 includes two hooks 51 extending from its interior side and engaging in two orifices 26, respectively, to prevent disengagement of the second holding device 50 from the first holding device 20. In the embodiment, each hook 51 is formed into the shape of a barb. The second holding device 50 also includes a slit 52 corresponding to and communicated with the hole 13 of the first shell member 111, and two ridges 55 moveably received in two guiding grooves 131, respectively. So, the ridges 55 would move in the associated guiding grooves 131 when the first controlling mechanism is urged between the first and second positions. The second holding device 50 further includes a first retaining section 53 and a second retaining section 54 for holding a switch 60 of the second controlling mechanism at a first position and a second position, respectively.

The switch 60 is adapted to urge the pressing member 40 to lock the razor 30 in the first controlling mechanism when it is in the first position, whereas the switch 60 is adapted to enable the pressing member 40 to unlock the razor 30 from the first controlling mechanism when it is in the second position. The switch 60 includes an operating section 61 exposed from the hole 13 of the first shell member 111. Preferably, the operating section 61 includes a plurality of ridges formed thereon for providing improved friction engagement for user. Although not shown, other means that is adapted to prevent user from slippage during the operation of the switch 60 is within the scope of the invention.

The switch 60 further includes an activating section 62 that is disposed in the shell 10 to cooperate with the pressing member 40. Specifically, the activating section 62 is disposed between the interior side of the second holding device 50 and the exterior side 402 of the pressing member 40. The activating section 62 includes an abutting surface 64 that urges the pressing member 40 to pivot to lock the razor 30 in the first controlling mechanism, and the abutting surface 64 would not urge the pressing member 40 in order to unlock the razor 30 from the first controlling mechanism. In addition, the activating section 62 includes a positioning section 63 formed thereon for selectively engaging in the first retaining section 53 when the switch 60 is in the first position or the second retaining section 54 when the switch 60 is in the second position. In the embodiment, the activating section 62 includes two positioning sections 63 disposed on opposing edges thereof, and each positioning section 63 is in the form of a ridge. Likewise, the second holding device 50 includes two first retaining sections 53 and two second retaining sections 54, and each of first 53 and/or second 54 retaining sections is in the form of a recess. In addition, one of the first retaining sections 53 is disposed on the right side of the slit 52 and the other is disposed on the left side of the slit 52. Likewise, one of the second retaining sections 54 is disposed on the right side of the slit 52 and the other is disposed on the left side of the slit 52.

While the specific embodiments have been illustrated and described, numerous modifications come to mind without significantly departing from the spirit of invention and the scope of invention is only limited by the scope of accompanying claims.

What is claimed is:

1. A scraper comprising:

a shell;

a razor;

a first controlling mechanism including a first holding device and a second holding device cooperating together to hold the razor, and being moveably installed within the shell, and being moveable between a first position that the razor is exposed outside the shell and a second position that the razor is concealed in the shell;

a second controlling mechanism in contact with the first controlling mechanism and including a pressing member disposed between the first and second holding devices, with the pressing member pivotally mounted on the first holding device, and with the pressing member being operable to pivot between a locked position that the razor is locked in the first controlling mechanism and an unlocked position that the razor is adapted to be disengaged and removed from the first controlling mechanism.

2. The scraper as claimed in claim 1 wherein the shell is made up by a first shell member and a second shell member, and wherein the first and second shell members include interior sides cooperated to from an accommodating space, and wherein the first controlling mechanism is received in the accommodating space.

3. The scraper as claimed in claim 2 wherein the first shell member includes a compartment defined by the interior side of the first shell member for storing a plurality of razors and wherein the second shell member includes a cavity extending therethrough for allowing the plurality of razors to be received in the compartment.

4. The scraper as claimed in claim 3 wherein the second shell member includes a removably mounted cover adjacent the cavity wherein the cover and the compartment encapsulate the plurality of razors.

5. The scraper as claimed in claim 1 wherein the shell includes a peripheral wall forming a lateral edge of the shell, and wherein the lateral edge includes a first opening defining an open end of the shell that would allow the first controlling mechanism to extend outside the shell, and a second opening defining a slot, and wherein the first holding device includes an operation handle disposed outside the shell and wherein the operation handle cooperates with the slot upon movement of the first controlling mechanism between the first and second positions.

6. The scraper as claimed in claim 5 wherein the first holding device includes a leg disposed in the shell and adapted to be operated for moving the first controlling mechanism between the first and second position, and wherein the leg includes two terminal ends and with one of the terminal ends formed on the first holding device and the other of the terminal ends exposed outside the shell, and wherein the operation handle is formed on the terminal end of the leg that is exposed outside of the shell.

7. The scraper as claimed in claim 6 wherein the leg is substantially L-shaped.

8. The scraper as claimed in claim 6 wherein the shell includes a first and a second locking sections, and wherein the leg includes a retaining section being selectively engagable in the first and second locking sections to hold the first holding device between the first and second positions.

9. The scraper as claimed in claim 1 wherein the shell includes a first and a second locking sections, and wherein the first controlling mechanism is selectively locked in the first or second locking sections upon movement of the first controlling mechanism between the first and second positions.

10. The scraper as claimed in claim 9 wherein the first locking section is more adjacent to the open end than the second locking section.

11. The scraper as claimed in claim 1 wherein the shell includes a compartment for storing a plurality of razors.

12. The scraper as claimed in claim 1 wherein the razor includes two opposing edges and with one of the edges defining a scraping edge including a scraping section extending thereon while the other of the edges defining a mounting edge, and wherein the razor also includes two lateral edges that extend between the scraping edge and the mounting edge, and the two lateral edges include two opposing notches formed thereon respectively, and wherein the razor includes an interior side and an exterior side, and with the mounting edge includes two ledges extending between the lateral edges thereof and with one of the ledges extending on the interior side while the other of the ledges extending on the exterior side.

13. The scraper as claimed in claim 12 wherein the first holding device includes an interior side including a channel defined therein for receiving the mounting edge of the razor, and wherein the channel includes a first flange and a second flange embanking the channel, and wherein the first flange is adapted to be abutted by the ledge on the interior side of the razor, thereby keeping the razor in the channel.

14. The scraper as claimed in claim 13 wherein the pressing member includes an interior side including a flange that is adapted to be abutted by the ledge on the exterior side of the razor, thereby facilitating to keep the razor in the locked position.

15. The scraper as claimed in claim 12 wherein the first holding device includes an interior side including a connecting groove defined therein, and wherein the pressing member includes a lug pivotally received in the connecting groove establishing the pivot mount, two protrusions extending from an interior side of the pressing member and adapted to insert through the two notches of the razor and abut the first holding device when the pressing member is in the locked position.

16. The scraper as claimed in claim 1 wherein the first holding device includes an interior side including a connecting groove defined therein, and wherein the pressing member includes a lug pivotally received in the connecting groove.

17. The scraper as claimed in claim 1 wherein the shell includes a hole extending therethrough, and wherein the second controlling mechanism further includes a switch including an operation section exposed from the hole and an engaging section engaging and urging the pressing member to the lock position when the switch is in a first position and when the switch is moved to a second position the engaging section disengages from the pressing member allowing the pressing member to pivot to the unlocked position.

18. The scraper as claimed in claim 17 wherein the engaging section includes a positioning section formed thereon, and wherein the second holding device includes a first retaining section and a second retaining section, and wherein the position section engages in the first retaining section when the switch is in the first position and the position section engages in the second retaining section when the switch is in the second position.

19. The scraper as claimed in claim 17 wherein the second holding device includes a slit corresponding to and in communication with the hole, and wherein the engaging section is disposed between the pressing member and the second holding device.

20. The scraper as claimed in claim 1 wherein the shell includes an interior side including a guiding groove formed therein, and wherein the second holding device includes an exterior side including a ridge formed therein, and wherein the ridge is moveably received in the guiding groove when the first controlling mechanism is urged between the first and second positions.

* * * * *